US007857916B2

(12) United States Patent
Chiba et al.

(10) Patent No.: US 7,857,916 B2
(45) Date of Patent: Dec. 28, 2010

(54) CO-CR-MO ALLOY FINE WIRE, MANUFACTURING METHOD THEREFOR, AND PLANAR BODY, TUBULAR BODY, STRANDED WIRE AND CABLE FORMED OF WIRE

(75) Inventors: Akihiko Chiba, Morioka (JP); Yoshiki Ono, Yokohama (JP); Shigemi Sato, Yokohama (JP); Michihiko Ayada, Yokohama (JP); Takeshi Suzuki, Yokohama (JP); Morimichi Kai, Yokohama (JP); Masashi Sakamoto, Yokohama (JP)

(73) Assignee: NHK Spring Co., Ltd, Kanagawa (JP)

( * ) Notice: Subject to any disclaimer, the term of this patent is extended or adjusted under 35 U.S.C. 154(b) by 479 days.

(21) Appl. No.: 10/821,170

(22) Filed: Apr. 9, 2004

(65) Prior Publication Data

US 2004/0221926 A1 Nov. 11, 2004

(30) Foreign Application Priority Data

Apr. 11, 2003 (JP) ..... 2003-107307
Dec. 1, 2003 (JP) ..... 2003-401900

(51) Int. Cl.
*C22C 19/07* (2006.01)
*B22D 23/00* (2006.01)

(52) U.S. Cl. ..... 148/425; 420/436; 164/46

(58) Field of Classification Search ..... 148/425; 420/436; 164/46
See application file for complete search history.

(56) References Cited

U.S. PATENT DOCUMENTS 5,061,275 A 10/1991 Wallstén et al.
5,891,191 A * 4/1999 Stinson ..... 623/1.2

FOREIGN PATENT DOCUMENTS

EP 0 518 704 A1 12/1992
EP 0 804 934 A2 11/1997
JP 01-150444 6/1989
JP 10-043314 2/1998
JP 2002-363675 12/2002
JP 2002363675 A * 12/2002

OTHER PUBLICATIONS

English Translation of JP 2002-363675.*
*Rapid Solidified Alloys, Processes, Structures, Properties, Applications*, H.H. Liebermann, pp. 143-144, 1993.
Patent Abstracts of Japan, vol. 012, No. 172 (C-497), May 21, 1998 & JP 62 280341 A, Dec. 5, 1987.

* cited by examiner

*Primary Examiner*—Roy King
*Assistant Examiner*—Jessee R. Roe
(74) *Attorney, Agent, or Firm*—Arent Fox LLP

(57) ABSTRACT

A Co—Cr—Mo alloy fine wire has superior biocompatibility, corrosion resistance, wear resistance, processability, and flexibility. A manufacturing method and a planar body or the like formed by processing this fine wire. This is a fine wire of diameter of 200 micrometers or less comprising 26 to 31 weight % of Cr, 8 to 16 weight % of Mo, and the remainder of Co and inevitable impurities, in which the degree of roundness (minor diameter/major diameter) of lateral cross section is 0.6 or more, and the internal structure is uniform with the concentration ratio of high Mo concentration phase to low Mo concentration phase of 1.8 or less.

14 Claims, 4 Drawing Sheets

Longitudinal cross section

Lateral cross section

Lateral cross section

CO-CR-MO ALLOY FINE WIRE, MANUFACTURING METHOD THEREFOR, AND PLANAR BODY, TUBULAR BODY, STRANDED WIRE AND CABLE FORMED OF WIRE

BACKGROUND OF THE INVENTION

1. Field of the Invention

The present invention relates to a Co—Cr—Mo alloy fine wire used in prosthetic materials for artificial bone, porous artificial bone material, porous embedded parts for medical and surgical purposes, wire and cable for bonding and fixing bone, bone bonding and fixing band processed by weaving or knitting fine wires, wire mesh and guide wire for stents for blood vessels, blood vessel plugging wire, and other medical implant devices, and relates to manufacturing methods, and relates to planar bodies and the like formed by processing this fine wire, and more particularly to a manufacturing technology for Co—Cr—Mo alloy fine wire having excellent biocompatibility, corrosion resistance, wear resistance, processability, and flexibility.

2. Related Art

Hitherto, a Co—Cr—Mo alloy has been known as a biocompatible alloy, but does not have good plastic processability, and hence the use of ingot and forged material thereof has been limited to rigid products of relatively large size, and it has been difficult to manufacture a fine wire suitable for biomaterials. However, since this alloy is excellent in biocompatibility, its application fields are wide, and it has been particularly demanded in the medical field. There has been a keen demand for development of fine wire made of this alloy having strength, wear resistance, and torsional rigidity conforming to dynamic characteristic of biomaterials, and flexibility fitting to the shape of biomaterials.

To meet such demands, a technology realizing plastic working by adding Ni to this alloy has been proposed (see patent reference 1, Japanese Laid-open Patent No. H10-43314). Specifically, by manufacturing a long member of Co—Cr—Mo containing Ni by less than 5 weight %, a transplantable medical device can be presented. However, Ni is allergenic, and it is preferred not to contain Ni in fine wire used in the medical field. According to the technology disclosed in patent reference 1, fine wires not containing Ni are also included, but only those containing Ni are shown in the embodiments of the detailed description of the invention, and it is not known whether or not Ni-free fine wire can be processed.

In this alloy, by increasing the Mo concentration and homogenizing the structure, both corrosion resistance and wear resistance are improved outstandingly, but in an ordinary ingot, as the Mo concentration increases, a stiff and brittle phase of high Mo concentration separates. As a result, at the time of plastic working, the working stress increases suddenly in the segregation phase, and cracking may occur, depending on the case, in the segregation phase or at the interface of segregation phase and matrix phase, and plastic working is difficult.

To solve this problem, a new technology is disclosed (patent reference 2, Japanese Laid-open Patent No. 2002-363675), that is, a molten alloy of Co—(26 to 30) weight % Cr—(6 to 12) weight % Mo—(0 to 0.3) weight % C is quenched and cast in a water-cooled copper die, the obtained material is processed by a hot forging method, and precipitates of high Mo concentration and second phase such as intermetallic compound are finely dispersed in grains of mean grain size of 50 micrometers or less, and by adjusting the structure in this manner, the plastic working performance is improved. If, however, an attempt is made to obtain a fine wire of 200 micrometers or less in diameter from the alloy of patent reference 2 by plastic working, if the second phase of high concentration Mo disperses granularly and finely, it is likely to be deformed, and only the second phase moves in the matrix phase (first phase), and the matrix phase may be damaged or holes and cracks may be formed in the matrix phase. Accordingly, to finish the alloy into a fine wire without causing such problems, it has been required to repeat the plastic working gradually in the structure control condition mentioned in patent reference 2. As a result, the number of steps is increased substantially, and the manufacturing cost increases.

In the prior art, further, as is clear from the description of claim 13 in the patent reference 1 and the corresponding embodiment of patent reference 1, no example is shown about the manufacture of fine wire with Mo content of 8 weight % or more, and there has been a strong demand for development of Ni-free fine wire with Mo content of 8 weight % or more, which is superior in corrosion resistance, wear resistance, and flexibility.

On the other hand, in the repeating method of forging as in the manufacturing method disclosed in patent reference 2, it is not easy to manufacture a fine wire of circular cross section, but it is rather possible to manufacture a flat band. It is also possible to manufacture a flat band by a roll method of using rapid quenching means by ejecting the molten metal to the chilling roll side. However, this flat band is poor in flexibility when fitted to a complicated shape in a human body, and it has been desired to develop a band processed by weaving or knitting a fine wire having a high degree of roundness (minor diameter/major diameter) of lateral cross section in order to improve the flexibility.

SUMMARY OF THE INVENTION

The invention was made in light of the above demands, and it is hence an object thereof to present a Co—Cr—Mo alloy fine wire capable of assuring the original excellent biocompatibility of Co—Cr—Mo alloy fine wire, exhibiting superior corrosion resistance, wear resistance, and processability, and excellent in fitting to shape of biomaterial, and a planar body and the like formed by processing this fine wire.

An outline of the invention is described below by classifying according to the purpose, that is, a first aspect of the invention and a second aspect of the invention.

First Aspect of the Invention

The present inventors have intensively researched various melt spinning methods as known methods for forming fine wires directly from molten alloy. As a result, in this Co—Cr—Mo alloy system which has been hitherto difficult to work, as a method of obtaining a fine wire of high degree of roundness (minor diameter/major diameter) of lateral cross section, it has been found preferable to employ a method of melt spinning in rotating liquid as disclosed, for example, in patent reference 3 (Japanese Patent Publication No. H7-36942) or a method of melt spinning in gas as disclosed in patent reference 4 (Japanese Laid-open Patent No. 2000-216090). Specifically, to manufacture a fine wire of circular cross section having roundness of lateral cross section of 0.6 or more, it is known to be preferable to employ the method of melt spinning in rotating liquid and obtain a fine wire of diameter of 200 micrometers or less by controlling the fine wire diameter by the nozzle diameter. To manufacture a fine wire of circular cross section having roundness of lateral cross section of 0.7 or more, it is known to be preferable to employ the method of melt spinning in gas and obtain a fine wire of diameter of 200 micrometers or less by controlling the fine wire diameter by the nozzle diameter.

If these two manufacturing methods are merely employed without specifying any conditions, although the shape of a fine wire may be obtained, if the thickness of fine wire exceeds a certain value, it is found that such fine wires are likely to be broken by bending deformation of 90 degrees or more, or that such fine wires are insufficient in ductility. As a result of investigation into the causes, as the fine wire increases in thickness, there are evidently high Mo concentration phases and low phases, which are found to be causes of poor ductility. Accordingly, by making the Mo concentration uniform, that is, by optimizing the concentration ratio of Mo concentration low phases and Mo concentration high phases, it is known to be possible to obtain fine wires which are excellent in ductility and also in processability.

The reason why a fine wire exceeding a diameter of 200 micrometers is likely to be broken is believed to be as follows: in the spinning means with a nozzle diameter exceeding 200 micrometers, there is a large difference in cooling speed between the surface and the interior of the molten alloy jet, deterioration of flexibility due to decrease in roundness and deterioration of ductility due to uneven Mo concentration are likely to occur, and it is difficult to bend by 90 degrees or more. If the diameter of the molten alloy jet before cooling is 200 micrometers or less, on the other hand, the higher the roundness of the molten alloy jet, the more uniform is the cooling from the side of the molten alloy jet in the circumferential direction, and it seems to contribute to uniformity of Mo concentration.

Furthermore, the Mo blending concentration is required to be 8 weight % or more in order to assure the corrosion resistance and wear resistance, but if it exceeds 16 weight %, if the diameter of the fine wire is 200 micrometers or less, bending deformation exceeding 90 degrees is difficult, and it is found that the ductility is poor. As for the Cr blending concentration, 26 weight % or more is needed to assure corrosion resistance, but if exceeding 31 weight %, when the Mo blending concentration is 8 weight %, bending deformation over 90 degrees is difficult, and it is known that the fine wire lacks in ductility. Meanwhile, considering the wear resistance and subsequent processing performance of fine wire, it is known that C may be added at about 0.3 weight %

The Co—Cr—Mo alloy fine wire of the invention is defined on the basis of the above findings, and it is a fine wire of diameter of 200 micrometers or less comprising 26 to 31 weight % of Cr, 8 to 16 weight % of Mo, and the remainder of Co and inevitable impurities, and the degree of roundness (minor diameter/major diameter) of lateral cross section is 0.6 or more, and the structure is uniform with the concentration ratio of high Mo concentration phase to low Mo concentration phase of 1.8 or less. Herein, the Mo concentration is measured by an X-ray microanalyzer by an electron beam at an acceleration voltage of 20 kV.

Thus, in the Co—Cr—Mo alloy fine wire of the invention, while maintaining the original excellent feature of biocompatibility, by optimizing the Mo concentration, excellent corrosion resistance, wear resistance and processability are achieved. Also by optimizing the Cr concentration, excellent corrosion resistance and processability are obtained. Moreover, by optimizing the degree of roundness of lateral cross section, a superior flexibility is achieved. Further, by optimizing the concentration ratio of low Mo concentration phase and high Mo concentration phase, an excellent ductility, that is, processability is realized. Meanwhile, by setting the diameter of fine wire to 200 micrometers or less, differences in cooling speed is reduced between the surface and the inside of the molten alloy jet, and lowering of the degree of roundness and nonuniformity of Mo concentration can be prevented. Still further, in light of the wear resistance and subsequent processing performance of fine wire, C can be added at about 0.3 weight %.

In such a Co—Cr—Mo alloy fine wire, preferably, the structure should be uniform with the concentration ratio of high Co concentration phase to low Co concentration phase of 1.1 or less, and similarly with the concentration ratio of high Cr concentration phase to low Cr concentration phase of 1.1 or less. By further optimizing the structure by thus optimizing the Co concentration or Cr concentration, a Co—Cr—Mo alloy fine wire having even more superior ductility and processability is obtained. Moreover, by defining the degree of roundness of lateral cross section at 0.8 or more, a Co—Cr—Mo alloy fine wire of higher flexibility is realized.

A manufacturing method of Co—Cr—Mo alloy fine wire of the invention is a method of manufacturing the fine wire described above preferably, and is characterized by injecting a molten alloy comprising 26 to 31 weight % of Cr, 8 to 16 weight % of Mo, and the remainder of Co and inevitable impurities from a nozzle of 200 micrometers or less in diameter to form a molten alloy jet, and quenching the molten alloy jet in a coolant layer formed along the inner circumference of a rotating cylindrical drum, thereby obtaining a fine wire.

Since this manufacturing method is a method of spinning in rotating liquid, the degree of roundness of lateral cross section can be set at 0.6 or more according to the findings by the inventors as described above, so that a sufficient flexibility of fine wire can be assured. According to this manufacturing method, as mentioned above, while assuring the original characteristic feature of this alloy of excellent biocompatibility, by optimizing the Mo concentration, Cr concentration and fine wire diameter, a Co—Cr—Mo alloy fine wire excellent in corrosion resistance, wear resistance, processability, and flexibility can be obtained.

Another manufacturing method for Co—Cr—Mo alloy fine wire of the invention is characterized by obtaining a fine wire by injecting a molten alloy comprising 26 to 31 weight % of Cr, 8 to 16 weight % of Mo, and the remainder of Co and inevitable impurities from a nozzle of 200 micrometers or less in diameter to form a molten alloy jet, and quenching the molten alloy jet in a cooling gas.

Since this manufacturing method is a method of melt spinning in gas, the degree of roundness of lateral cross section can be set at 0.8 or more according to the findings by the inventors as described above, and a higher flexibility can be assured. Concerning the biocompatibility, corrosion resistance, wear resistance, and processability, excellent effects as in the foregoing manufacturing method can be obtained.

In a further different manufacturing method of Co—Cr—Mo alloy fine wire of the invention, a molten alloy comprising 26 to 31 weight % of Cr, 8 to 16 weight % of Mo, and the remainder of Co and inevitable impurities is injected downward from a nozzle of 200 micrometers or less in diameter to form a molten alloy jet, and a cooling gas is introduced into a tube collecting gas disposed so as to surround the falling path of the molten alloy jet, and a fine wire is obtained by quenching the molten alloy jet, and then the fine wire is discharged outside from the discharge unit of the tube collecting gas.

Since this manufacturing method is also a method of melt spinning in gas, the degree of roundness of lateral cross section can be set at 0.7 or more, and a high flexibility can be also assured. Concerning the biocompatibility, corrosion resistance, wear resistance, and processability, excellent effects as in the foregoing manufacturing methods can be obtained.

Comparing the manufacturing method by the process of spinning in rotating liquid and the manufacturing method by the process of melt spinning in gas, a fine wire of higher degree of roundness is more easily obtained in the method of melt spinning in gas, and the reason is as follows. In the former case, before the molten alloy jet is solidified, it rushes into the rotating coolant layer, and the molten alloy jet is bent in the running direction of the coolant, and at this time it is likely to be flattened. In the latter case, by contrast, while the molten alloy metal is falling linearly and flying in the gas atmosphere until solidified, the roundness is self-corrected by the surface tension of the molten alloy jet, and an ultrathin shell of Cr oxide system is formed on the surface. As a result, between the fine wires manufactured by two melt spinning methods, a difference occurs in the roundness.

In the manufacturing method by melt spinning in gas, the cooling gas is desired to contain oxygen. More preferably, the cooling gas should be composed of a first gas component comprising inert gas to be introduced into the tube collecting gas at a first position closer to the nozzle in the falling direction of the molten alloy jet, and a second gas component comprising oxidizing gas to be introduced into the tube collecting gas at a second position at lower side of the first position. In this case, the first gas component is argon or helium, and the second gas component is oxygen or carbon dioxide. Further, at lower side, third and fourth cooling gas feed parts may be disposed in order to promote cooling of the molten alloy jet.

This is the manufacturing method of Co—Cr—Mo alloy fine wire of the invention, and from this fine wire, a planar body may be formed by weaving, knitting, or nonwoven processing, a tubular body may be formed by weaving, knitting, or nonwoven processing, and a stranded wire and cable may be formed by processing, and they are excellent in biocompatibility, corrosion resistance, wear resistance, processability, and flexibility, and hence can be applied in various medical implant devices.

According to the first aspect of the invention, while maintaining the excellent feature of biocompatibility of Co—Cr—Mo alloy, by optimizing the Mo concentration, optimizing the Cr concentration, optimizing the roundness, and optimizing the diameter of fine wire, excellent corrosion resistance, wear resistance, processability, and flexibility of fine wire can be assured.

Second Aspect of the Invention

The present inventors have further researched various melt spinning methods as known methods for forming fine wires directly from molten alloy. As a result, in this Co—Cr—Mo alloy system which has been hitherto difficult to work, as a method of obtaining a fine wire having a high degree of roundness (minor diameter/major diameter) of lateral cross section, it has been found preferable to employ a method of melt spinning in rotating liquid as disclosed, for example, in patent reference 3 or a method of melt spinning in gas as disclosed in patent reference 4. Specifically, to manufacture a fine wire of circular cross section having roundness of lateral cross section of 0.6 or more, it is known to be preferable to employ the method of melt spinning in rotating liquid and obtain a fine wire of diameter of 200 micrometers or less by controlling the fine wire diameter by the nozzle diameter. To manufacture a fine wire of circular cross section having roundness of lateral cross section of 0.7 or more, it is known preferable to employ the method of melt spinning in gas and obtain a fine wire of diameter of 200 micrometers or less by controlling the fine wire diameter by the nozzle diameter.

If these two manufacturing methods are merely employed without specifying any condition, although the shape of a fine wire may be obtained, if the thickness of the fine wire exceeds a certain value, it is found that fine wires are likely to be broken by bending deformation of 90 degrees or more, or that some of the fine wires are insufficient in ductility. As a result of investigations into the causes, as the fine wire increases in thickness, there is an unknown phase in addition to the gamma phase and the epsilon phase in the internal structure, and it is found to be a cause of poor ductility. It is also known that the existence of such unknown phase become more evident as the diameter of fine wire increases. From such a viewpoint, it is known that the ductility and processability of fine wire can be improved by eliminating this unknown phase.

The reason why a fine wire exceeding a diameter of 200 micrometers is likely to be broken is believed to be as follows. That is, in the spinning means with a nozzle diameter exceeding 200 micrometers, there is a large difference in cooling rate between the surface and the interior of the molten alloy jet, and deterioration of flexibility is likely to occur due to precipitation of an unknown phase promoted by uneven concentration of Mo. As a result, in particular, it is difficult to bend by 90 degrees or more. If the diameter of the molten alloy jet before cooling is 200 micrometers or less, on the other hand, the higher the roundness of the molten alloy jet, the more uniform is the cooling from the side of the molten alloy jet in the circumferential direction, and it seems to contribute to uniformity of Mo concentration and prevention of precipitation of unknown phases.

Furthermore, the Mo blending concentration is required to be 8 weight % or more in order to assure the corrosion resistance and wear resistance. However if the Mo blending concentration exceeds 16 weight %, if the diameter of the fine wire is 200 micrometers or less, bending deformation exceeding 90 degrees is difficult, and it is found that the ductility is poor. As for the Cr blending concentration, 26 weight % or more is needed to assure corrosion resistance. However, if the Cr blending concentration exceeds 31 weight %, when the Mo blending concentration is 8 weight % or more, bending deformation over 90 degrees is difficult, and it is known that the fine wire will have poor ductility. Meanwhile, considering the wear resistance and subsequent processing performance of fine wire, it is known that C may be added by about 0.3 weight %.

The Co—Cr—Mo alloy fine wire of the invention is defined on the basis of the above findings, and it is a fine wire of diameter of 200 micrometers or less comprising 26 to 31 weight % of Cr, 8 to 16 weight % of Mo, and the remainder of Co and inevitable impurities, and the degree of roundness (minor diameter/major diameter) of lateral cross section is 0.6 or more, and the internal structure is substantially composed of either gamma phase (Co base solid solution of face-centered cubic system) or epsilon phase (Co base solid solution of hexagonal close-packed system) only, or both of them only. In this Co—Cr—Mo alloy fine wire, the roundness of the lateral cross section is preferred to be 0.7 or more.

A first manufacturing method of Co—Cr—Mo alloy fine wire of the invention is classified as a method of melt spinning in rotating liquid, in which a molten alloy comprising 26 to 31 weight % of Cr, 8 to 16 weight % of Mo, and the remainder of Co and inevitable impurities is injected into a cooling layer formed along the inner circumference of a rotating cylindrical drum through a nozzle of 200 micrometers or less in diameter, thereby obtaining a fine wire of diameter of 200 micrometers or less, roundness of lateral cross section (=minor diameter/major diameter) of 0.6 or more, with the internal structure substantially composed of either gamma phase (Co base solid solution of face-centered cubic system) or epsilon phase (Co base solid solution of hexagonal close-packed system) only, or both of them only.

A second manufacturing method of Co—Cr—Mo alloy fine wire of the invention is classified as a method of melt spinning in gas, in which a molten alloy comprising 26 to 31 weight % of Cr, 8 to 16 weight % of Mo, and the remainder of Co and inevitable impurities is injected from a nozzle of 200 micrometers or less in diameter, and the injection jet is quenched and solidified in a cooling gas, thereby obtaining a fine wire of diameter of 200 micrometers or less, roundness of lateral cross section (=minor diameter/major diameter) of 0.7 or more, with the internal structure substantially composed of either gamma phase (Co base solid solution of face-centered cubic system) or epsilon phase (Co base solid solution of hexagonal close-packed system) only, or both of them only.

A third manufacturing method of Co—Cr—Mo alloy fine wire of the invention is also classified as a method of melt spinning in gas in the same manner in as the second manufacturing method, in which a molten alloy comprising 26 to 31 weight % of Cr, 8 to 16 weight % of Mo, and the remainder of Co and inevitable impurities is injected downward in a falling state, and a molten alloy jet is formed by a nozzle of 200 micrometers or less in diameter, and further by using a tube collecting gas disposed to surround the falling path of the molten alloy jet, cooling gas feed means for feeding the cooling gas for solidifying the molten alloy jet into the tube collecting gas, and discharge means for discharging the fine wire obtained by solidification of the molten alloy jet to outside from the tube collecting gas, a fine wire is obtained, this fine wire having a diameter of 200 micrometers or less, roundness of lateral cross section (=minor diameter/major diameter) of 0.7 or more, with the internal structure substantially composed of either gamma phase (Co base solid solution of face-centered cubic system) or epsilon phase (Co base solid solution of hexagonal close-packed system) only, or both of them only.

In the manufacturing method by melt spinning in gas (second and third manufacturing method), the cooling gas should preferably contain oxygen. In the third manufacturing method, the cooling gas is preferably composed of a first gas component of inert gas introduced into the tube collecting gas at a first position closer to the nozzle in the falling direction of the molten alloy jet, a second gas component of oxidizing gas introduced into the tube collecting gas at a second position at lower side of the first position, and a third gas component of higher cooling capacity than the second gas components introduced into the tube collecting gas at a third position at lower side of the second position. In this case, the first gas component is preferably argon or helium, and the second gas component is oxygen or carbon dioxide. Further, at a lower side of the third position, fourth and fifth cooling gas feed parts may be disposed in order to promote cooling of the molten alloy jet.

This is the manufacturing method of Co—Cr—Mo alloy fine wire of the invention, and from this fine wire, a planar body may be formed by weaving, knitting, or nonwoven processing, a tubular body may be formed by weaving, knitting, or nonwoven processing, and a stranded wire and cable may be formed by processing, and they are excellent in biocompatibility, corrosion resistance, wear resistance, processability, and flexibility, and hence can be used in various medical implant devices.

As described herein, in the Co—Cr—Mo alloy fine wire of the invention, while maintaining its excellent feature of biocompatibility, by optimizing the Mo concentration, excellent corrosion resistance, wear resistance and processability are obtained. By optimizing the Cr concentration, excellent corrosion resistance and processability are obtained. By optimizing the roundness of lateral cross section, excellent flexibility is obtained. Furthermore, by limiting the internal structure substantially to either gamma phase (Co base solid solution of face-centered cubic system) or epsilon phase (Co base solid solution of hexagonal cose-packed system) only, or both of them only, excellent ductility, that is, processability, is obtained. Moreover by setting the diameter of the fine wire to be 200 micrometers or less, difference in cooling rate is reduced between the surface and the interior of the molten alloy jet, and reduction of roundness, uneven Mo concentration, and precipitation of unknown phase can be prevented.

In this Co—Cr—Mo alloy fine wire, the concentration of each element is preferred to be uniform. As a result, it is easier to obtain an internal structure substantially composed of gamma phase or epsilon phase only, or both phases only, so that a Co—Cr—Mo alloy excellent in ductility or processability is realized. By setting the roundness to be 0.7 or more, a more flexible Co—Cr—Mo alloy fine wire is obtained.

In the first manufacturing method of Co—Cr—Mo alloy fine wire of the invention, which is a method of melt spinning in a rotating liquid, the roundness of lateral cross section is set at 0.6 or more according to the findings obtained by the present inventors, and a sufficient flexibility of fine wire is assured. Moreover, according to this manufacturing method, while assuring the excellent intrinsic feature of biocompatibility of the alloy, by optimizing the internal structure and diameter of fine wire, a Co—Cr—Mo alloy fine wire which has excellent corrosion resistance, wear resistance, and processability is obtained.

In the second manufacturing method of Co—Cr—Mo alloy fine wire of the invention, which is a method of melt spinning in gas, the roundness of the lateral cross section is set at 0.7 or more according to the findings obtained by the present inventors, and a higher flexibility is assured as compared with the first manufacturing method. As for the biocompatibility, corrosion resistance, wear resistance, and processability, excellent effects are obtained in the same manner as in the first manufacturing method.

In the third manufacturing method of Co—Cr—Mo alloy fine wire of the invention, which is also a method of melt spinning in gas, the roundness of the lateral cross section is set at 0.7 or more, and a high flexibility is assured in the same manner as in the second manufacturing method. As for the biocompatibility, corrosion resistance, wear resistance, and processability, excellent effects are obtained in the same manner as in the first and second manufacturing methods.

Comparing the manufacturing method by the process of melt spinning in rotating liquid and the manufacturing method by the process of melt spinning in gas, a fine wire of higher degree of roundness is more easily obtained in the method of melt spinning in gas, and the reasons are as follows. In the former case, before the molten alloy jet is solidified, it rushes into the rotating coolant layer, and the molten alloy jet is bent in the running direction of the coolant, and at this time it is likely to be flattened. In the latter case, by contrast, while the molten alloy metal is falling linearly and flying in the air until solidified, the roundness is self-corrected by the surface tension of the molten alloy jet. As a result, between the fine wires manufactured by the two spinning methods, a difference occurs in the roundness.

EXAMPLES

Embodiment 1

Corresponding to the First Aspect of the Invention

Figure 1:
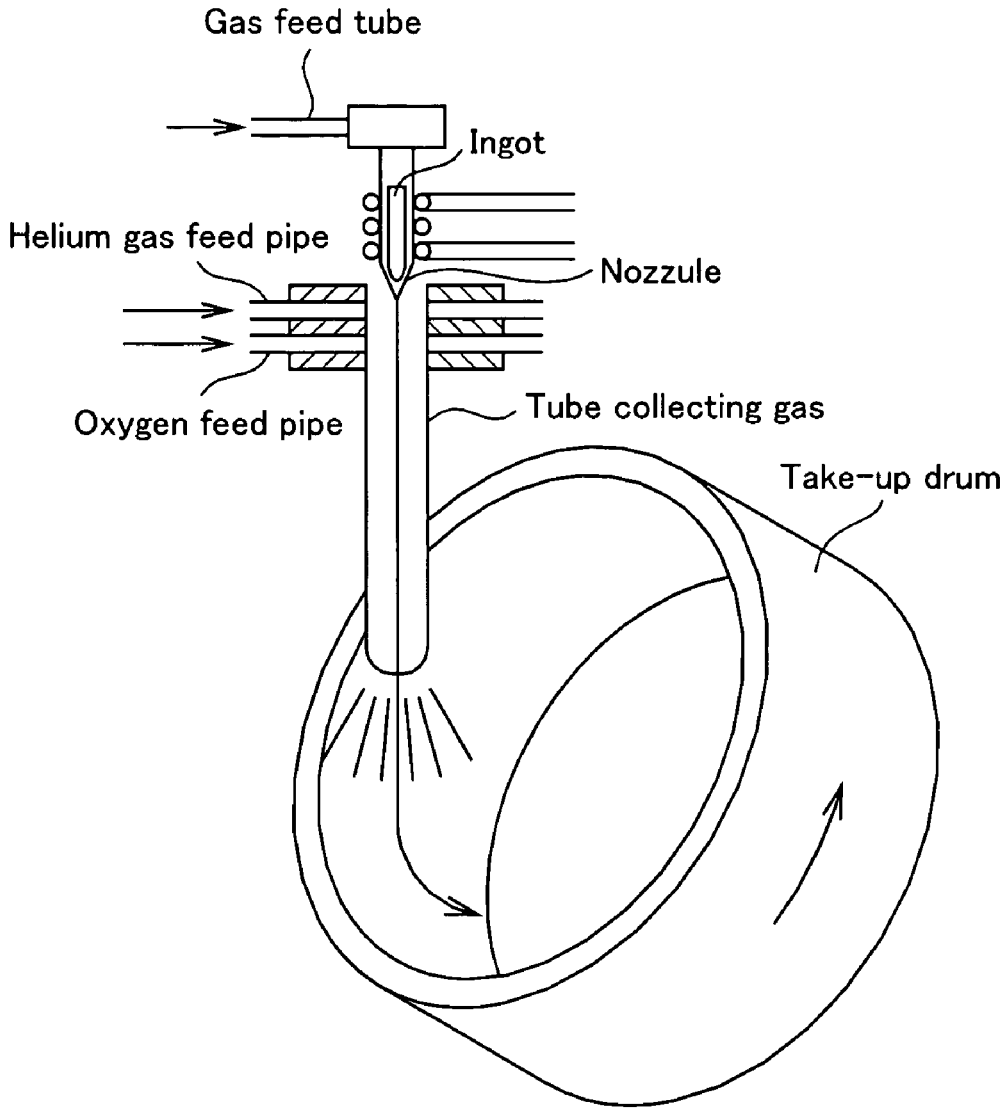
FIG. 1 is a schematic view of an apparatus used in manufacture of Co—Cr—Mo fine wire by the method of melt spinning in gas.

The first aspect of the invention is specifically described below. When manufacturing a Co—Cr—Mo alloy fine wire, in the case of method of melt spinning in gas, the apparatus shown in FIG. 1 is used. Specifically, as shown in the drawing, alloy materials were heated and melted in a crucible having a nozzle at the leading end, the molten alloy jet injected from the nozzle was cooled by helium gas and oxygen gas, and a solidified fine wire was obtained, and it was taken up on a winding drum. In the case of the method of melt spinning in a rotating liquid, an normal apparatus as shown in patent reference 3 was used. The roundness is calculated from arbitrarily selected minor diameter and major diameter.

Manufacturing Example 1

Using an alloy of composition of Co—29 weight % Cr—(8, 12, 16) weight % Mo, fine wires of representative diameters of 70 micrometers, 100 micrometers, and 150 micrometers were obtained by the method of melt spinning in gas. Roundness of the obtained fine wires settled in a range of 0.8 to 0.9, and bending deformation of 90 degrees or more was possible. The internal structure was a uniform composition with the concentration ratio to the Mo concentration of 1.8 or less.

Figure 2A:
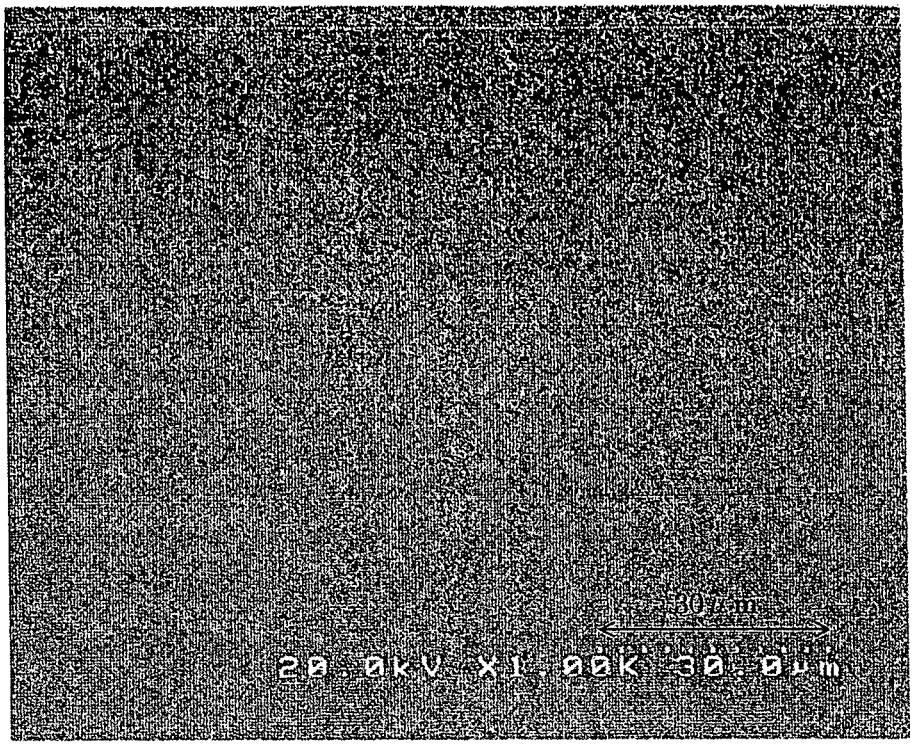
FIG. 2A is a composition image of fine wire of Co—29 weight % Cr-8 weight % Mo, in a longitudinal cross section
Figure 2B:
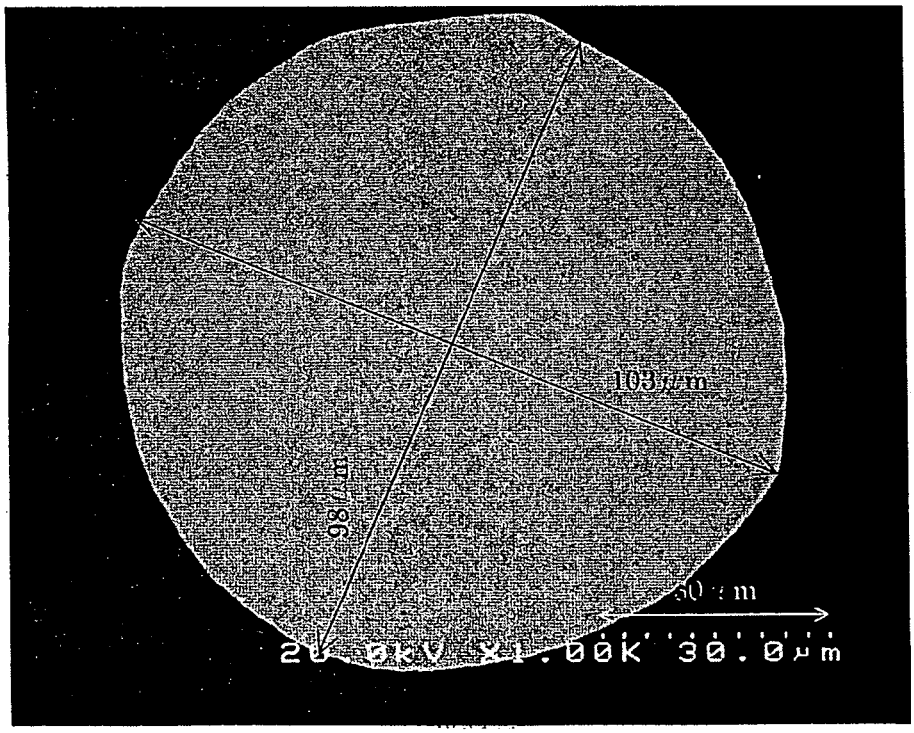
FIG. 2B is a lateral cross section thereof.

In particular, in the fine wire of representative diameter of 100 micrometers of Co—29 weight % Cr—8 weight % Mo, the blending composition and Mo concentration ratio were measured at two positions each in the longitudinal cross section and lateral cross section, and results are shown in Table 1. Pack scattering electron images (hereinafter called composition images) by an electron microscope in longitudinal cross section and lateral cross section are shown in FIGS. 2A and 2B. Although not shown in FIGS. 2A and 2B, longitudinal cross section 1 (and lateral cross section 1) in Table 1 refers to a relatively dark portion arbitrarily selected in the longitudinal cross section (lateral cross section), and longitudinal cross section 2 (and lateral cross section 2) refers to a relatively light portion arbitrarily selected in the longitudinal cross section (and lateral cross section). Further, in the fine wire of representative diameter of 100 micrometers of Co—29 weight % Cr—12 weight % Mo, the blending composition and Mo concentration ratio were measured at two positions each in the longitudinal cross section and lateral cross section, and the results are shown in Table 2.

TABLE 1

| | Concentration (weight %) | | |
|---|---|---|---|
| Measuring position | Co | Cr | Mo |
| Longitudinal cross section 1 | 62.29 | 29.4 | 8.31 |
| Longitudinal cross section 2 | 60.79 | 29.14 | 10.07 |
| Lateral cross section 1 | 64.73 | 27.79 | 7.48 |
| Lateral cross section 2 | 63 | 28.79 | 8.21 |
| Mo concentration ratio | | | 1.35(10.07/7.48) |

TABLE 2

| | Concentration (weight %) | | |
|---|---|---|---|
| Measuring position | Co | Cr | Mo |
| Longitudinal cross section 1 | 59.63 | 28.01 | 12.36 |
| Longitudinal cross section 2 | 55.19 | 27.36 | 17.45 |
| Lateral cross section 1 | 59.84 | 27.95 | 12.21 |
| Lateral cross section 2 | 54.71 | 27.41 | 17.88 |
| Mo concentration ratio | | | 1.46(17.88/12.21) |

As is clear from Table 1 and FIGS. 2A and 2B, the obtained fine wire is 98 micrometers in minor diameter and 103 micrometers in major diameter, and the roundness is 0.95, which is within a preferred range of the invention. This fine wire can be bent and deformed by 90 degree or more. Furthermore, as shown in Table 1, the internal structure is a uniform composition with the concentration ratio to Mo concentration of 1.4 or less. As is clear from Table 2, moreover, the internal structure of the obtained fine wire is a uniform composition with the concentration ratio to Mo concentration of 1.5 or less.

Manufacturing Example 2

Using an alloy of composition of Co—27 weight % Cr—(10, 14) weight % Mo, fine wires of diameters of 120 micrometers, 150 micrometers, and 180 micrometers were obtained by the method of melt spinning in rotating liquid with the circumference speed of molten alloy jet equal to the speed of a rotary drum. Roundness of the obtained fine wires ranged from 0.7 to 0.8, and bending deformation of 90 degrees or more was possible. The internal structure was a uniform composition with the concentration ratio to the Mo concentration of 1.4 or less.

Manufacturing Example 3

Figure 3:
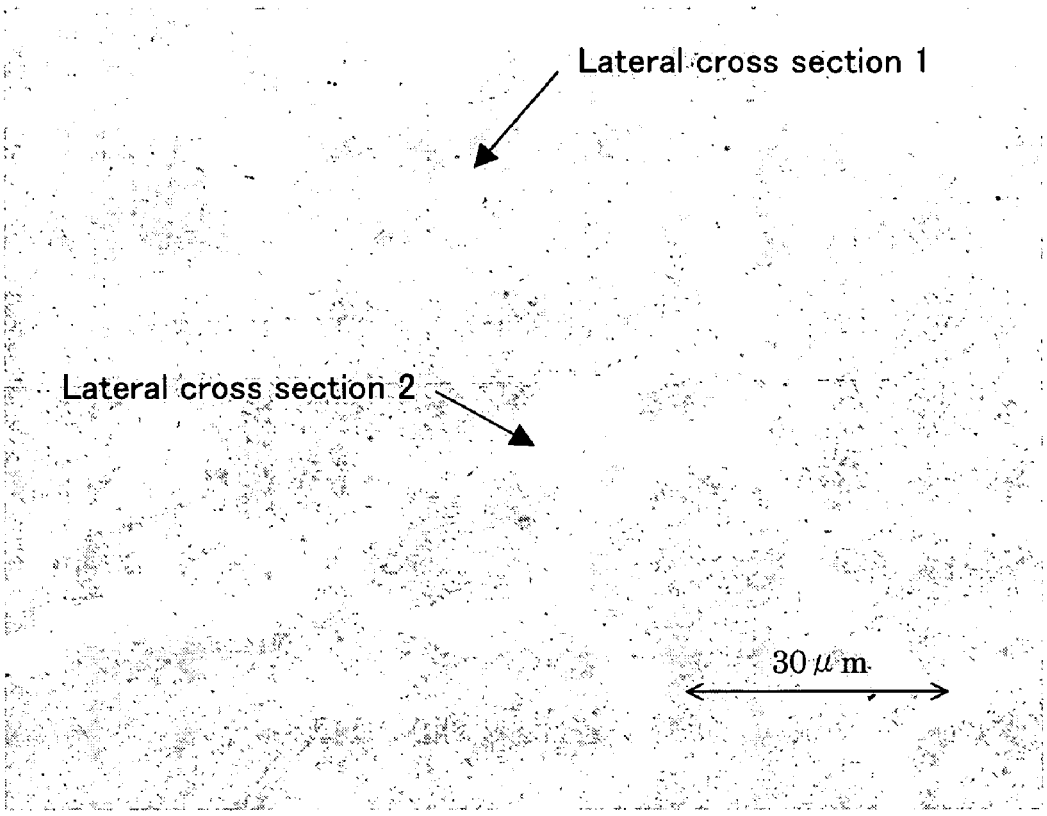
FIG. 3 is a composition image in a lateral cross section of ordinary ingot of Co—29 weight % Cr-8 weight % Mo.

FIG. 3 shows a composition image in lateral cross section of ordinary ingot of Co—29 weight % Cr—8 weight % Mo. As shown in the drawing, this composition image was clearly divided into Mo low concentration phase (lateral cross section 1) and high concentration phase (lateral cross section 2), and the concentration ratio was 2.6 or more. Table 3 shows the concentration of each element and Mo concentration ratio at lateral cross section 1 and lateral cross section 2. Table 4 shows the concentration of each element and Mo concentration ratio at lateral cross section 1 and lateral cross section 2 of ordinary ingot of Co—29 weight % Cr—12 weight % Mo.

TABLE 3

| | Concentration (weight %) | | |
|---|---|---|---|
| Measuring position | Co | Cr | Mo |
| Lateral cross section 1 | 63.78 | 29.2 | 7.02 |
| Lateral cross section 2 | 49.55 | 31.88 | 18.57 |
| Mo concentration ratio | | | 2.65(18.57/7.02) |

TABLE 4

| Measuring position | Concentration (weight %) | | |
|---|---|---|---|
| | Co | Cr | Mo |
| Lateral cross section 1 | 62.76 | 28.2 | 9.04 |
| Lateral cross section 2 | 48.05 | 30.89 | 21.07 |
| Mo concentration ratio | | | 2.33(21.67/9.04) |

According to Tables 3 and 4, the Mo concentration ratio did not satisfy the preferable values of the invention. By drawing these ingods, it was difficult to manufacture fine wires of diameter of 200 micrometers.

Manufacturing Example 4

Using an alloy of composition of Co—29 weight % Cr—8 weight % Mo, a fine wire of diameter of 250 micrometers was obtained by the method of melt spinning in rotating liquid. Since this wire exceeds a diameter of 200 micrometers, and the roundness ranged from 0.4 to 0.8, partly out of the preferred range of the invention. The internal structure was not a uniform composition, with the concentration ratio to the Mo concentration exceeding 1.8. The wire could not be bent and deformed by 90 degrees or more.

Embodiment 2

Corresponding to the Second Aspect of the Invention

The second aspect of the invention is specifically described below. When manufacturing a Co—Cr—Mo alloy fine wire, in the case of a method of melt spinning in gas, the apparatus shown in FIG. 1 is used. Specifically, as shown in the drawing, alloy materials were heated and melted in a crucible having a nozzle at the leading end, the molten alloy jet injected from the nozzle was cooled by helium gas and oxygen gas, and a solidified fine wire was obtained, and it was wound on a winding drum. In the case of the method of melt spinning in rotating liquid, an normal apparatus as shown in patent reference 3 was used. The roundness is calculated from a selected minor diameter and a major diameter.

Manufacturing Example 5

Using an alloy of composition of Co—29 weight % Cr—(8, 12, 16) weight % Mo, fine wires of representative diameters of 70 micrometers, 100 micrometers, and 150 micrometers were obtained by the method of melt spinning in gas. Roundness of the obtained fine wires settled in a range of 0.8 to 0.9, and bending deformation of 90 degrees or more was possible. The internal structure satisfied the scope of claim 9, that is, it was substantially composed of either gamma phase (Co base solid solution of face-centered cubic system) or epsilon phase (Co base solid solution of hexagonal close-packed system) only, or both of them only.

Figure 4:
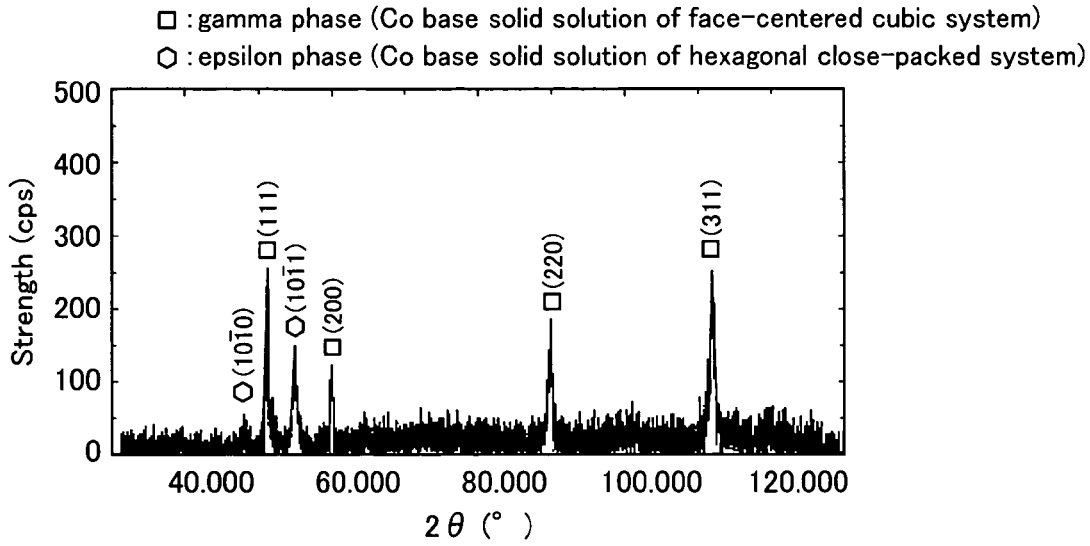
FIG. 4 is an X-ray diffraction pattern of fine wire of Co—29 weight % Cr-8 weight % Mo manufactured by the method of melt spinning in gas.

In particular, in the fine wire of representative diameter of 100 micrometers of Co—29 weight % Cr—8 weight % Mo, "composition images" were taken by electron microscope in lateral cross section, and the results are shown in FIG. 2B. The structure of the obtained fine wire was relatively uniform, almost free from uneven composition, and the minor diameter was 98 micrometers and the major diameter was 103 micrometers, and hence the roundness was 0.95, which falls in the preferred range of the invention. In this fine wire, further, X-ray (Co—Kα) diffraction pattern was measured, and the results are shown in FIG. 4. It is found that the internal structure is substantially composed of gamma phase (Co base solid solution of face-centered cubic system) and epsilon phase (Co base solid solution of hexagonal close-packed system) only. This fine wire could be also bent and deformed by 90 degrees or more. Hence, in the fine wire of Manufacturing Example 5, phases other than gamma phase (Co base solid solution of face-centered cubic system) and epsilon phase (Co base solid solution of hexagonal close-packed system) could not be detected by the X-ray (Co—Kα) diffractometer.

Manufacturing Example 6

Using an alloy of composition of Co—27 weight % Cr—(10, 14) weight % Mo, fine wires of representative diameters of 120 micrometers, 150 micrometers, and 180 micrometers were obtained by the method of melt spinning in rotating liquid with the speed of molten alloy jet equal to the circumferential speed of the rotary drum. Roundness of the obtained fine wires ranged from 0.6 to 0.8, and bending deformation of 90 degrees or more was possible. As a result of X-ray diffraction measurement, the internal structure was substantially composed of gamma phase (Co base solid solution of face-centered cubic system) and epsilon phase (Co base solid solution of hexagonal close-packed system) only. Hence, in the fine wire of Manufacturing Example 6, phases other than gamma phase (Co base solid solution of face-centered cubic system) and epsilon phase (Co base solid solution of hexagonal close-packed system) could not be detected by the X-ray (Co—Kα) diffractometer.

Manufacturing Example 7

Figure 5:
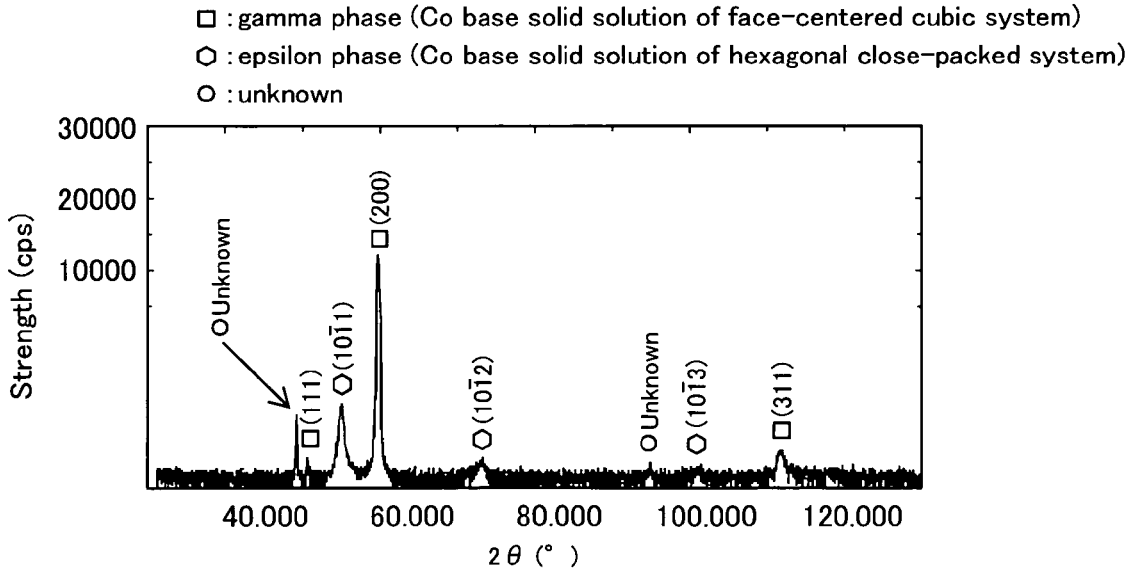
FIG. 5 is an X-ray diffraction pattern of an ordinary ingot of Co—29 weight % Cr—8 weight % Mo.

From an alloy of composition of Co—29 weight % Cr—8 weight % Mo, an alloy ingot was obtained by conventional casting. The internal structure was clearly divided into a Mo high concentration phase (pale portion) and low concentration phase (dark position) as shown in the composition image in FIG. 3. Results of X-ray (Co—Kα) diffraction measurement of this alloy ingot are shown in FIG. 5. As a result, the internal structure was found to include an unknown phase other than the gamma phase (Co base solid solution of face-centered cubic system) and the epsilon phase (Co base solid solution of hexagonal close-packed system). From this ingot, it was difficult to manufacture a fine wire of diameter of 200 micrometers by drawing process.

Manufacturing Example 8

Using an alloy of composition of Co—29 weight % Cr—8 weight % Mo, a fine wire of diameter of 550 micrometers was obtained by the method of melt spinning in rotating liquid. Roundness of the obtained wire ranged from 0.3 to 0.6, and bending and deformation by more than 90 degrees was impossible. The internal structure was found to include a phase other than gamma phase (Co base solid solution of face-centered cubic system) and epsilon phase (Co base solid solution of hexagonal close-packed system).

What is claimed is:

1. A Co—Cr—Mo alloy fine wire for biomaterials, consisting of: 26 to 31 weight % of Cr; more than 8 weight % to 16 weight % of Mo; and the remainder of Co and inevitable impurities, the alloy being Ni-free; the wire having a diameter of 200 micrometers or less and a degree of roundness (minor diameter/major diameter) of lateral cross section of 0.6 or more, and a uniform structure with a concentration ratio of maximum Mo concentration phase with respect to minimum Mo concentration phase of 1.8 or less when Mo concentration is measured at one or more arbitrarily selected cross sections of said fine wire, wherein the wire was obtained by injecting the melted Co—Cr—Mo alloy from a nozzle to form a melted alloy jet and cooling and solidifying the melted alloy jet.

2. The Co—Cr—Mo alloy fine wire of claim 1, wherein the structure is uniform with the concentration ratio of maximum Co concentration phase to minimum Co concentration phase of 1.1 or less when Co concentration is measured at one or more arbitrarily selected cross sections of said fine wire.

3. The Co—Cr—Mo alloy fine wire of claim 1, wherein the structure is uniform with the concentration ratio of maximum Cr concentration phase to minimum Cr concentration phase of 1.1 or less when Cr concentration is measured at one or more arbitrarily selected cross sections of said fine wire.

4. The Co—Cr—Mo alloy fine wire of claim 1, wherein the roundness of lateral cross section is 0.7 or more.

5. A planar body formed by weaving, knitting or nonwoven processing of the Co—Cr—Mo alloy fine wire of claim 1.

6. A tubular body formed by weaving, knitting or nonwoven processing of the Co—Cr—Mo alloy fine wire of claim 1.

7. A stranded wire formed by processing of the Co—Cr—Mo alloy fine wire of claim 1.

8. A cable formed by processing of the Co—Cr—Mo alloy fine wire of claim 1.

9. A Co—Cr—Mo alloy fine wire for biomaterials, consisting of 26 to 31 weight % of Cr, more than 8 weight % to 16 weight % of Mo; and the remainder of Co and inevitable impurities, the alloy being Ni-free; the wire having a diameter of 200 micrometers or less and a degree of roundness (minor diameter/major diameter) of lateral cross section is 0.6 or more, and wherein an internal structure is composed of either gamma phase (Co base solid solution of face-centered cubic system) or epsilon phase (Co base solid solution of hexagonal close-packed system) only, or both of them only, wherein the wire was obtained by injecting the melted Co—Cr—Mo alloy from a nozzle to form a melted alloy jet and cooling and solidifying the melted alloy jet.

10. The Co—Cr—Mo alloy fine wire of claim 9, wherein the roundness of lateral cross section is 0.7 or more.

11. A planar body formed by weaving, knitting or nonwoven processing of the Co—Cr—Mo alloy fine wire of claim 9.

12. A tubular body formed by weaving, knitting or nonwoven processing of the Co—Cr—Mo alloy fine wire of claim 9.

13. A stranded wire formed by processing of the Co—Cr—Mo alloy fine wire of claim 9.

14. A cable formed by processing of the Co—Cr—Mo alloy fine wire of claim 9.

* * * * *